US010965055B2

(12) United States Patent
Kompa et al.

(10) Patent No.: US 10,965,055 B2
(45) Date of Patent: Mar. 30, 2021

(54) CONNECTORS AND RELATED METHODS

(71) Applicant: Bal Seal Engineering, LLC, Foothill Ranch, CA (US)

(72) Inventors: Joshua Kompa, Foothill Ranch, CA (US); David Wang, Tustin, CA (US); Tony Quach, Chino, CA (US)

(73) Assignee: Bal Seal Engineering, LLC, Foothill Ranch, CA (US)

( * ) Notice: Subject to any disclaimer, the term of this patent is extended or adjusted under 35 U.S.C. 154(b) by 0 days.

(21) Appl. No.: 15/633,337

(22) Filed: Jun. 26, 2017

(65) Prior Publication Data

US 2017/0373427 A1 Dec. 28, 2017

Related U.S. Application Data

(60) Provisional application No. 62/354,577, filed on Jun. 24, 2016.

(51) Int. Cl.

| | |
|---|---|
| ***H01R 13/518*** | (2006.01) |
| ***H01R 13/17*** | (2006.01) |
| ***H01R 13/187*** | (2006.01) |
| ***H01R 13/24*** | (2006.01) |
| ***H01R 13/04*** | (2006.01) |
| ***H01R 13/18*** | (2006.01) |
| ***H01R 13/627*** | (2006.01) |
| *H01R 24/58* | (2011.01) |
| *H01R 13/66* | (2006.01) |

(52) U.S. Cl.

CPC ..... *H01R 13/518* (2013.01); *H01R 13/04* (2013.01); *H01R 13/17* (2013.01); *H01R 13/18* (2013.01); *H01R 13/187* (2013.01); *H01R 13/2421* (2013.01); *H01R 13/2471* (2013.01); *H01R 13/6271* (2013.01); *H01R 13/6691* (2013.01); *H01R 24/58* (2013.01)

(58) Field of Classification Search

CPC ..... H01R 13/187; H01R 13/33; H01R 13/41; H01R 13/052; H01R 24/48; H01R 2103/00; H01R 2107/00

USPC ..... 439/669, 668, 827, 840

See application file for complete search history.

(56) References Cited

U.S. PATENT DOCUMENTS

| | | | |
|---|---|---|---|
| 3,174,500 | A | 3/1965 | Johnson et al. |
| 4,678,210 | A | 7/1987 | Balsells |

(Continued)

FOREIGN PATENT DOCUMENTS

| | | |
|---|---|---|
| DE | 19807663 | 9/1999 |
| GB | 2194298 | 3/1988 |
| WO | WO 03067713 | 8/2003 |

OTHER PUBLICATIONS

Extended European Search Report from European Patent Office on co-pending EP application (EP17177782.4) dated Nov. 8, 2017.

*Primary Examiner* — Hien D Vu

(74) *Attorney, Agent, or Firm* — Klein, O'Neill & Singh, LLP

(57) ABSTRACT

A connector assembly having a pin and a housing. The pin having an insulator layer or material separating two adjacent electrical contacts. The electrical contacts can each include a contact band and a tab extending from the contact band. An electrical contact can be established with a spring contact and the contact band can at least partially surrounds the insulator around the lengthwise axis of the pin. Two electrical contacts can be positioned in an axial or longitudinal offset configuration.

20 Claims, 8 Drawing Sheets

(56) References Cited

U.S. PATENT DOCUMENTS 4,872,710 A 10/1989 Konecny et al.
5,411,348 A 5/1995 Balsells
5,468,164 A * 11/1995 Demissy ..... H01H 1/385 439/821
5,545,842 A 8/1996 Balsells
6,672,565 B2 1/2004 Russell
6,835,084 B2 12/2004 Poon et al.
7,538,289 B2 5/2009 Carroll
7,722,415 B2 * 5/2010 Chansrivong ..... H01R 13/15 439/840
7,914,315 B2 3/2011 Kuhn et al.
7,914,351 B2 3/2011 Balsells et al.
8,052,459 B2 * 11/2011 Smith ..... A61N 1/3752 439/372
8,096,842 B2 1/2012 Poon et al.
8,308,167 B2 11/2012 Balsells et al.
8,382,532 B2 2/2013 Sjostedt et al.
8,491,346 B2 7/2013 Sjostedt et al.
8,561,274 B2 10/2013 Balsells
9,004,805 B2 4/2015 Changsrivong et al.
9,267,526 B2 2/2016 Balsells
9,284,970 B2 3/2016 Dilmaghanian et al.
9,312,630 B2 4/2016 Huang
9,482,255 B2 * 11/2016 Changsrivong ..... F16B 17/00
9,500,211 B2 11/2016 Changsrivong
9,534,625 B2 1/2017 Balsells
9,677,587 B2 6/2017 Changsrivong et al.
2002/0122690 A1 9/2002 Poon et al.
2003/0096526 A1 5/2003 Balsells
2007/0117433 A1 * 5/2007 Pavlovic ..... H01R 13/187 439/188
2008/0255631 A1 10/2008 Sjostedt et al.
2013/0149031 A1 6/2013 Changsrivong et al.
2014/0259617 A1 * 9/2014 Kompa ..... F16F 1/045 29/450

* cited by examiner

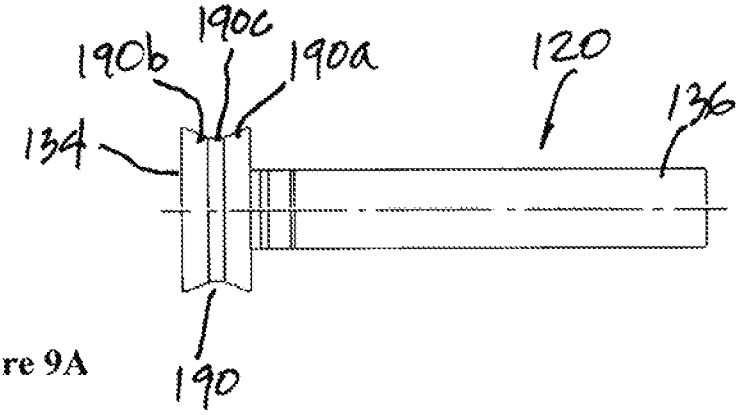
Figure 9A
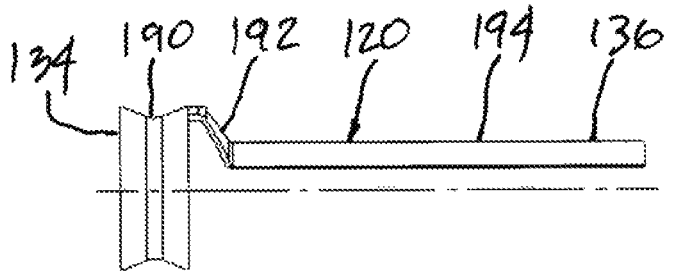
Figure 9B
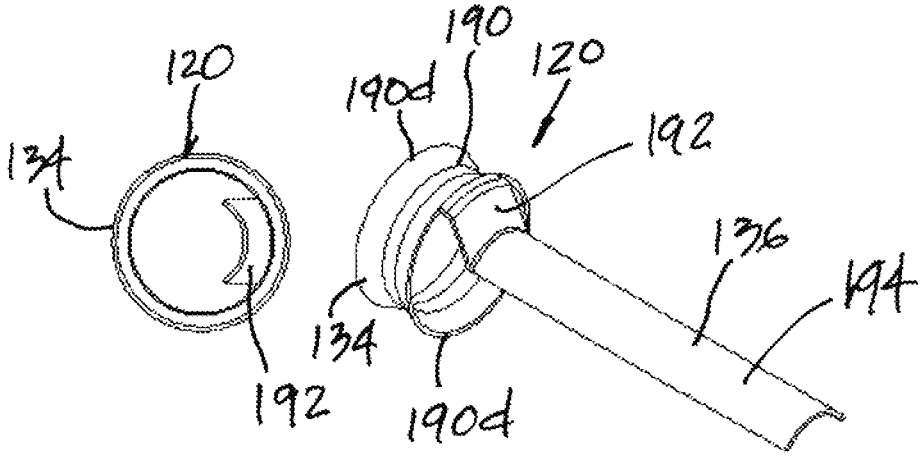
Figure 10A
Figure 10B

CONNECTORS AND RELATED METHODS

FIELD OF ART

The present invention generally relates to connectors and more particularly to electrical connectors capable of high density electrical connections and applications and methods thereof.

BACKGROUND

Conventional spring contact and housing connectors may typically transfer a single signal from one source to another. This limitation is generally due to the size and/or material of the connector. Multiple signals are limited to the width of said connector, material of said connector, or may require multiple separate connectors. Increasing the number of connectors would require an increase in the overall cost of the final product. The pin of said connectors may typically be formed through the machining of a singular conductive material.

SUMMARY

The present invention allows multiple sources to pass through generally similar sized components by offsetting longitudinally multiple electrical contacts in an orientation so that they are not interfering with one another while maintaining the width of the connector assembly to be approximately the same as a single prior art connector assembly.

Each electrical contact can comprise a tab which may carry a different signal than a tab of another electrical contact all while being housed on a singular pin or same pin body. The pin can comprise an insulation material separating said electrical contacts.

The pin itself may be formed from an insulator material, such as a dielectric material or a non-conductive material, and part of the pin can be situated to isolate the two electrical contacts form one another. The end result can be a single pin with the capability of carrying multiple signals across multiple contacts while maintaining a typical width.

Aspects of the invention introduced herein can comprise a connector with similar electrical contacts comprising a tab in an offset position. Regardless of different geometries of the contact band of the connector, where electrical contact comprises a tab, the present disclosure introduces an offset position for two adjacent tabs.

Each electrical contact can comprise a tab which may carry a different signal all while being housed on or in a singular pin or single pin body. The pin can primarily be comprised of insulation material separating said electrical contacts. The end result can be a single pin with the capability of carrying multiple signals while maintaining a typical width.

Aspects of the present disclosure include a connector assembly comprising a pin and a housing. The pin can comprise an insulator material and an electrical contact and the housing can comprise an exterior surface and an interior surface defining a bore. The connector assembly can further comprise a spring contact; a direction of insertion of said pin into said bore of said housing; wherein the pin comprises an axis in the direction of insertion; wherein the electrical contact comprises a contact band where contact is to be established with the spring contact, said contact band at least partially surrounds the insulator material around the axis of the pin; wherein said electrical contact comprises a tab extending from the contact band and along at least a length of the pin; and wherein the spring contact establishes an electrical path between the pin and the housing when the pin is inserted into the bore of the housing.

The electrical contact can be a first electrical contact and the spring contact can be a first spring contact and the assembly can further comprise a second electrical contact and a second spring contact.

The pin can comprise two spaced apart pin grooves including a first pin groove and a second pin groove and wherein the first electrical contact can be located in the first pin groove and the second electrical contact can be located in the second pin groove. The two pin grooves can be separated from one another by an intermediate section, which can be a wall structure unitarily formed with the tip section of the pin.

The spring contact can be retained with a housing groove of the housing prior to insertion of the pin into the bore of the housing.

The contact can be retained with a groove of the pin prior to insertion of the pin into the bore of the housing.

The tab of the electrical contact can be connected to a source.

The tab of the electrical contact can be connected to a receiver.

The contact band of the first electrical contact and a contact band of a second electrical contact can be arranged in an axially offset configuration.

The electrical contact can be stamped from a metal sheet.

The stamped electrical contact can be stamped using one or more cutting dies.

The electrical contact can be formed by metal injection molding or is can be molded by metal injection.

The pin can be molded from a plastic material.

The pin can be molded or formed from a rubber material.

The electrical contact can comprise copper or a copper alloy.

The contact band of the electrical contact can be non-continuous and have a gap. The contact band with the gap can snap onto an insulator surface of a pin.

The pin can comprise two or more grooves to separate the electrical contacts located within the grooves.

The electrical contacts can embody a plurality of similarly stamped parts with variations in groove designs.

The contact band of an electrical contact can comprise a V shape surface.

The contact band of an electrical contact can comprise two sidewalls and a flat bottom surface fur fitting into a square-groove of a pin groove.

The tab of the electrical contact that extends can be flexible. The cross-sectional profile of the tab can be arc shape or can be flat.

The spring contact can be located in a bore of a housing and a second spring contact can be mounted on an electrical contact if a pin prior to insertion of the pin to the housing.

A further aspect of the present invention is a connector assembly comprising: a pin comprising an insulator material and an electrical contact; a housing comprising an exterior surface and an interior surface defining a bore; a spring contact; a direction of insertion of said pin into said bore of said housing; wherein the pin comprises an axis in the direction of insertion; wherein the electrical contact comprises a contact band where contact is to be established with the spring contact, said contact band at least partially surrounds the insulator material around the axis of the pin; wherein said electrical contact comprises a tab extending from the contact band and along at least a length of the pin;

and wherein the spring contact establishes an electrical path between the pin and the housing when the pin is inserted into the bore of the housing.

A method of using the connector assembly as described herein comprising the step of separating the pin from the bore of the housing.

A method of making the connector assembly as described herein, comprising the step of assembling the contact assembly to the pin.

A connector assembly can comprise a housing and a pin. The pin can be inserted into the bore of the housing to connect the pin to the housing.

A still further aspect of the present disclosure is a connector assembly comprising: a housing comprising an exterior surface and an interior surface defining a bore; a pin located in the bore of the housing, the pin comprising a tip section and a tail section, said tip section having a diameter that is larger than a diameter of the tail section; a spring contact contacting a contact band of an electrical contact, said electrical contact comprising a tab extending from the contact band and said spring contact and said contact band located inside the bore of the housing; and wherein said tab extends along a length of said tail section of said and is orthogonal to a plane defined by the contact band.

The contact band can be located in a pin groove of the pin. The pin can further comprise a second pin groove comprising one sidewall or two sidewalls including a first sidewall and a second sidewall and wherein the first sidewall is taller than the second sidewall.

The tab can be embedded inside said tail section.

The contact band can have a gap and two side edges defining the gap.

The connector assembly can comprise a second spring contact and a second contact band of a second contact element, said second spring contact and said second contact band can be located in the bore of the housing.

The spring contact can be located in a pin groove of the pin and a second spring contact can be located in a housing groove of the housing. The housing can further comprise a second pin groove comprising one sidewall or two sidewalls including a first sidewall and a second sidewall and wherein the first sidewall is taller than the second sidewall.

The pin can latch to the housing by capturing a spring contact between two grooves, one groove on the housing and one groove on the pin. In an example, the housing can comprise a housing body comprising two open ends having end openings, including a first open end and a second open end. In other examples, the housing body can have a single open end for receiving the pin and a closed end.

When there are two open ends of a housing, part of the pin can project out the opening of the second open end. The housing can be made from a metal material. The housing can be made from an electrically conductive metal material and can be coated or plated with one or more outer metal layers.

Means can be provided to connect the pin and the housing. The means for connecting, such as latching, holding, or locking, can include spring contacts and grooves. In some examples, as discussed below, the connector assembly can incorporate electrical contacts and functions as an electrical contact assembly. In exemplary embodiments, the housing can be made from a dielectric material or a non-conductive material and can incorporate electrical contacts for passing contact signals or current through the housing, similar to electrical contacts discussed further below for use with the pins of the present disclosure.

The pin for use in or with the connector assembly can comprise a pin body, one or more electrical contacts, and one or more spring contacts. The pin body can be made from a non-conductive material or a dielectric material and can be an insulator or can be called an insulator material. High temperature resistant plastic, resin, polymer, or ceramic may be used to form the pin body. Non-limiting exemplary high temperature plastics and polymers can include Vespel®, Torlon®, PEEK (poletheretherketone), Ultem®, Radel®, Teflon®, Meldin®, Rulon®, Celazole®, and Macor®.

A housing and a pin with two electrical contacts and two spring contacts can be incorporated for a connector assembly. The two electrical contacts can be identified as a first electrical contact and a second electrical contact. The two spring contacts can be identified as a first spring contact and a second spring contact. In an example, the two spring contacts can each be a canted coil spring. In particular examples, the canted coil spring can be a radial canted coil spring comprising a plurality of interconnected coils that all cant in generally the same direction and each comprising a major axis and a minor axis.

In some examples, the coils of the canted coil spring can each have an elliptical shape and in a spring ring configuration. In some examples, the coils of the canted coil spring can each have a shape other than elliptical, such as square, triangle, or one of the complex coil shapes disclosed in U.S. Publication No. 2016/0076568 (the '568 publication), the contents of which are expressly incorporated herein by reference as if set forth in full.

The first electrical contact can have a contact band and a tab located above the centerline of the pin and the second electrical contact can have a contact band and a tab that is located below the centerline of the pin, in a particular orientation of the pin. The terms first and second can be used to distinguish two components but not necessarily features or structures of the two components unless the context indicates otherwise.

The pin can have a hollow bore extending the length of the pin. In other examples, the hollow bore can extend only part of the length of the pin or the pin can have a solid core. The first and second electrical contacts can be substantially similar or can differ. For example, the two contact bands can be substantially the same but the tabs have different lengths and/or different widths. Alternatively, the contact bands can be similar and the tabs differ.

Each tab can have a length that is at least as long as the width of the contact band. In other examples, the tab can have a length that is at least two times the width of the contact band. In some examples, the contact bands can have different shapes for mounting onto different shaped grooves on the pin body.

The tab can extend a length that is equal to one width dimension of the contact band. In other examples, the length can extend an amount equal to two or more width dimension of the contact band.

The contact paths for electrical transmission between the housing and the electrical contacts mounted with the pin can be with or via the spring contacts, which can be canted coil springs each comprising a plurality of interconnected canted coils, all canted generally along the same direction. Alternatively, the spring contacts can be a ribbon spring or a V-spring. The pin can have a tapered insertion end to facilitate insertion of the pin into the bore of the housing. In some examples, the insertion end can embody a semi-spherical shape.

The two electrical contacts have contact bands and tabs that are assembled to the pin in an offset configuration with the two contact bands of the two electrical contacts concentric with the lengthwise axis of the pin and the contact band of the second electrical contact can be located closer to the tapered end section of the pin than the contact band of the first electrical contact. Said differently, the pin can comprise contact bands positioned along the pin axis having different axial positions relative to the axial lengthwise axis of the pin.

In an example, the first and second electrical contacts utilized with the contact assembly do not touch one another. In another example, the first and second electrical contacts never touch one another. The electrical contacts can be offset from each other, at least longitudinally or axially. In another example, the two electrical contacts do not touch circularly or in the radial direction relative to the lengthwise axis of the pin.

The bore of the housing can be sized so that the outer diameter of the pin does not touch the interior surface of the housing. The spring contacts can be sized so that electrical paths provided by the spring contacts simultaneously contact the housing and the two contact bands. In exemplary embodiments, the housing can also be provided with a non-conducting or a dielectric layer that separates the two areas where the two spring contacts contact the interior surface of the housing defining the bore. This arrangement can provide two distinct electrical paths through the housing and through the pin.

In an example, the pin can have two electrical contacts and the pin body can be formed by insert molding. The pin can be formed with a tip section and a tail section. The tip section can be formed with two slots or grooves having the two contact bands located therein and the tail section of the pin can have the two tabs of the two electrical contacts embedded within the wall or boundary of the tail section.

In an example, the pin body of the pin can comprise two metallic bands located in two spaced apart slots or grooves and two tabs embedded within the boundary or wall of the tail section. The ends of the two tabs, i.e., tab ends, can extend from the end most part of the tail section of the pin. In an example, the two tab ends can couple to wires, leads, cables, or other electrical sources for electrical communication with one or more electrical sources connected to the housing.

The pin body can be made from a non-conducting material or a dielectric material. At least some part or section of the pin body can be placed between the electrical contacts to isolate the first and second electrical contacts from one another. For example, parts or sections of the pin body can isolate or serve as a non-conducting element or dielectric layer between the two electrical contacts. This isolation between two adjacent electrical contacts enables the usage of multiple signals or conductive paths through a single connector assembly, such as through a single housing and a single pin. A centerline can be provided to show the direction of insertion of the pin into the bore of the housing.

Electric power or data can be routed through the connector assembly between two or more nodes. For example, a controller can connect to the housing and two circuit boards can connect to the two tabs extending along the tail section of the pin. In other example, a power source can connect to the housing and two different nodes, such as drivers, controllers, or motors connect to the two tabs extending along the tail section of the pin. Other electronic devices or sources can be connected to the connector assembly of the present disclosure.

The housing can have an open end having an opening. The housing can have a similar opening on the opposite open end. The housing can be made entirely from a conductive material and can include dielectric or non-conductive layers or materials to isolate parts of the housing with an insulator.

Optionally, the housing can be provided with a same number or conductive rings as there are spring contacts and the conductive rings can be insert molded with a housing body made from a non-conductive or a dielectric material.

The housing can be provided with annular grooves formed by machining or recessing the nominal interior surface of the bore of the housing. The two grooves can include a first groove or first housing groove and a second groove or second housing groove. The housing can have an interior surface defining the bore of the housing. The two grooves can have groove bottom surfaces that are recessed from the interior surface of the housing.

Where the spring contacts are pin mounted, the spring contacts may establish electrical contacts with the grooves inside the bore of the housing. The two housing grooves may be in electrical communication with one another or may be electrically isolated from one another using one or more dielectric layer or non-conductive layers between them for separately contacting the two spring contacts and two electrical contacts.

For the connector assemblies and connector assembly components disclosed hereinafter, it is understood that where a feature is shown but not expressly described and is otherwise the same or similar to the feature or features described elsewhere, such as above with reference to FIGS. 1-4, the disclosed part or parts shown in all the drawing figures but not expressly described because of redundancy and because knowledge is built on a foundation laid by earlier disclosures may nonetheless be understood to be described or taught by the same or similar features expressly set forth in the text for the embodiments in which the feature or features are described. Said differently, subsequent disclosures of the present application are built upon the foundation of earlier disclosures unless the context indicates otherwise.

The disclosure is therefore understood to teach a person of ordinary skill in the art the disclosed embodiments and the features of the disclosed embodiments without having to repeat similar components and features in all embodiments since a skilled artisan would not disregard similar structural features having just read about them in several preceding paragraphs nor ignore knowledge gained from earlier descriptions set forth in the same specification. As such, the same or similar features shown in the following connector assemblies and connector components incorporate the teachings of earlier embodiments unless the context indicates otherwise. Therefore, it is contemplated that later disclosed embodiments enjoy the benefit of earlier expressly described embodiments, such as features and structures of earlier described embodiments, unless the context indicates otherwise.

A housing-mounted spring contact is shown for use in a connector assembly with a pin, the pin being without any spring contact. Said differently, rather than mounting one or more spring contacts with a pin prior to engaging the pin to a housing, the housing can include housing grooves that can be sized and shaped to receive spring contacts, which can be canted coil springs, prior to receiving a pin within the bore of the housing.

Each housing groove can have a V-bottom and two sidewalls. In other examples, the housing groove can have other groove shapes, such as a V-groove without sidewalls, a U-shape groove, a groove with two parallel sidewalls and a bottom wall that is flat, tapered or curved, etc. Each housing groove can have a depth that is sized to receive more than half of a coil minor axis of each coil of the plurality of coils of the spring contact and with part of each coil extending out of the housing groove to be received by a corresponding mating groove on a pin.

A centerline can be shown to indicate the direction of insertion of a connecting pin into the housing to latch the pin to the housing, said pin can comprise a pin body having a tip section and a tail section, at least one electrical contact having a contact band and a tab but no spring contact for use with a housing that has spring contacts mounted therewith.

A pin with two contact springs can be provided, such as two spaced apart canted coil springs, prior to insertion of the pin into a housing. The pin can have spring contacts mounted thereon or therewith and the pin can be configured for insertion into a housing bore of a housing and wherein said housing is without any spring contact. The pin can include two electrical contacts having contact bands and tabs assembled to the pin in an offset configuration. The two spring contacts can contact the two contact bands on the two spring contacts. In other examples, the housing can have a spring contact and the pin can have a spring contact and wherein the pin with the spring contact can connect to the housing with the spring contact.

A pin provided herein can comprise a pin body comprising a tip section having two spaced apart pin grooves and an insertion end and a tail section. The tail section can have an outer dimension, such as an outer diameter or outer circumference, that is smaller than an outer diameter or dimension of the pin body, away from the two pin grooves.

The pin body may be formed from a dielectric or non-conducting material to function as an insulator separating two spring contacts and two electrical contacts from one another. The pin body can have two spaced part pin grooves, which may be referred to as a first pin groove and a second pin groove. In other examples, the pin can have more than two pin grooves. The two pin grooves can be separated from one another by an insulating intermediate section, which can be an integral part of the tip section of the pin or a unitarily formed part of the tip section of the pin.

Each pin groove can have a bottom wall and two sidewalls. The two sidewalls can be generally parallel to one another and the bottom wall can be V-shape, V-shape with a subtended surface between two tapered surfaces of the V-shape, or V-shaped with a subtended surface without any sidewall. In an example, the two spaced apart pin grooves can have substantially the same shape. In other examples, the two grooves have different groove shapes, such as shown with reference to FIGS. 14A and 14B.

Two electrical contacts can be insert molded with the pin. Each electrical contact can comprise a contact band and a tab extending from the band. The two contact bands can be molded to the bottom walls of the two grooves and serve as bottom surfaces of the respective grooves for contacting corresponding spring contacts.

Each contact band can have a surface that resembles the bottom surface of the respective pin groove. In some examples, the contact band can have side lips that from parts of the two sidewalls of the respective pin groove.

Thus, aspects of the present connector assembly can be understood to include a housing and a pin, said pin comprising an electrical contact comprising a contact band comprising an arcuate band section for enveloping at least part of the pin along a radial direction and a tab extending from the contact band and down the tail section of the pin. The arcuate band section can have a matching contour as a bottom of a pin groove. The tab can be integrated within the interior boundary of the tail section of the pin and have a tab end extending externally of the end of the tail section.

In exemplary embodiments, a second electrical contact having a contact band spaced from the contact band of the first electrical contact can be provided with the pin. The second contact band can be situated in a second pin groove and can have an arcuate band section having a matching contour as a bottom of the second pin groove.

Two electrical contacts having contact bands that are offset along an axial or longitudinal direction can be provided with a pin. The two contact bands can be insert molded with the pin or can snap onto to grip the pin. The two contact bands can be generally V-shape and can be located in corresponding grooves having two sidewalls and a center wall or bottom wall located therebetween, said bottom wall of the pin groove having a matching groove bottom surface as the cross-sectional contour of a corresponding contact band. The two pin grooves with the contact bands can be sized and shaped to receive spring contacts. The two pin grooves can have the same size and/or shape or can be different.

A tab can extend from each contact band. The tab of the second electrical contact can have a length that is longer than the length of the tab of the first electrical contact since the contact band of the second electrical contact can be located closer to the tapered end insertion end of the pin than the contact band of the first electrical contact but wherein the two tab ends terminate on approximately the same plane. In other examples, the tab ends can terminate along different axial positions.

The electrical contacts mounted with or attached to the pin can be spaced from one another. The spaced relationship of the two electrical contacts allows the single pin to have at least two or more spring contacts for two or more electrical contact paths, which are spaced or isolated from one another. As shown, the two tabs can be routed inside the boundary or wall surface of the tail section of the pin and having two tab ends projecting out from the end most surface of the pin.

In some examples, the tab ends of contact elements can project out other parts of the pin, such as out the side or sides of the tail section of the pin.

The contact band of the electrical contact can comprise an arcuate band section that can have a matching contour as a bottom of a pin groove in which a spring contact can be located or positioned. The tab can be elongated and can have a connecting portion and an extension portion.

The extension portion can have a length and a width with an arc section, which can form an arc around the lengthwise axis of the electrical contact. In an example, the width of the arc section of the tab can form about 10% to about 40% of a circumference of a circle. The length of the tab allows the tab to extend down the pin or along at least part of the length of the pin.

The connecting portion can be angled from the contact band towards the lengthwise axis of the electrical contact. In an example, the contact band and the tab are unitarily formed and can include a weld to close the loop of the contact band and/or to connect the tab to the contact ring. In other examples, the electrical contact can be formed by a stamping process and can involve welding to either close a seam of the contact band and/or to attach the tab to the contact band.

The arcuate band section of the contact band can have two tapered walls and a bottom wall located therebetween. The arcuate band section can have a general V-shape with a subtended surface between the two inclined surfaces, which can be understood as being tapered walls. In an example, the electrical contact can be made in whole or in part from stamped metal parts and cold worked to final fit. Optionally, the electrical contact can be machined and welded when made from multiple separate pieces to final fit. The electrical contact can optionally be formed by metal injection molding or is molded by metal injection.

An electrical contact disclosed herein can be configured for use with a pin described elsewhere herein and optionally with one or more other electrical contacts to enable the pin to have two or more electrical paths. The contact band can be a continuous loop. In other examples, the contact band can be non-continuous, such as having a gap and can function as a snap ring.

The contact band can have an inside diameter and an outside diameter. The connecting portion on the tab can angle towards the center of the contact band. The extension portion can extend generally perpendicularly to a plane defined by the contact band.

The contact band can have a surface contour along the width of the contact band. The contact band can have two tapered surfaces or tapered walls and a bottom wall or bottom surface. In other examples, the surface contour along the width can differ. For example, the surface can have a U-shape, can have an arc shape, and the two upper edges of the two tapered walls can include an upwardly extending lip to form part of or the height of each of the two sidewalls of a pin groove.

The tab of an electrical contact can have a connecting portion and an extension portion with a length and a width. The length of the tab can be selected as appropriate for use with a pin and the width of the tab can be about 10% to about 40% of a circumference of a circle and can have a general flat cross-sectional profile or an arc shape.

A contact band of an electrical contact can have a continuous loop and can have a generally square shape configuration or ring. In other examples, the contact band can be non-continuous and can have a different shape, such as a generally rectangular shape.

A contact band of a contact element can have a continuous loop and can have a generally triangular shape. In other examples, the contact band can be non-continuous and can have a different shape, such as generally rectangular or oval.

A contact band of a contact element can have a non-continuous loop with a gap between two band side edges. The band can have a generally round shape with a gap. The contact band is not closed off so that it may at least partially surround an insulator, such as a pin, around a majority of the circumference thereof.

A non-continuous configuration of the contact band of the present electrical contact embodiment enables the contact band to snap onto a pin made from a non-conducting or a dielectric material rather than assembling to the pin by insert molding, although the latter process is still an option. The connecting portion and the extension portion can be adjusted when using the electrical contact with the gap by snap fit to a pre-formed pin made from a non-conducting or a dielectric material.

A contact band of an electrical contact can have a surface contour along the width of the contact band. The width of the contact band can have a generally U-shape with two short sidewalls and a bottom wall located therebetween. The bottom wall can be generally flat and the surface contour of the bottom wall can be generally parallel to the lengthwise axis of the electrical contact. In other examples, the surface contour along the width can differ. For example, the surface can have a V-shape, can have an arc shape, and the two upper edges of the two tapered walls can include an upwardly extending lip to form part of or the height of each of the two sidewalls of the pin groove. In still other examples, the two sidewalls can be omitted and the tab can extend directly from the bottom wall. The tab can have a connecting portion and an extension portion with a length and a width. The length of the tab can be selected as appropriate for use with a pin and the width of the tab can be about 10% to about 40% of a circumference of a full circle and can have a general flat cross-sectional profile or an arc shape.

A connector assembly can comprise a pin comprising a pin body having a tip section and a tail section configured for use with a housing. The pin can further comprise two pin grooves including a first pin groove and a second pin groove. In other examples, additional pin grooves can be incorporated.

A contact band of an electrical contact having a gap or a non-continuous loop can attach to the second groove with two side edges and the gap on the contact ring located within a pin groove of a pin.

A tab can extend from the contact band with the gap and extends along the tail section of a pin and having a tab end extending beyond the end of the tail section or extending out from a surface of the tail section. The tip section of the pin can be provided with lengthwise channels to accommodate the width of the tab running from the area of the grooves through the remainder of the tip section and along the tail section of the pin. Adhesive, heat welds, detents, or combinations thereof may be used to secure the tab to the pin.

Another electrical contact spaced from the pin can snap onto the pin. The contact band of the electrical contact can have a gap. The pin can comprise a non-conducting material or materials for use as an isolator to isolate the electrical contacts and spring contacts. A tab can extend from the contact band with a gap and can pass through a lengthwise channel formed through or in the tip section of the pin with the remaining portion of the tab extending along the exterior of the tail section. The tail section may include a lengthwise channel so that the tab can recess from the exterior surface of the tail section.

Thus, an aspect of the present disclosure can include a process in which an electrical contact has a contact band and wherein the contact band at least partially surrounds the insulator around the axis of the pin.

A pin can have two locations where two electrical contacts can be located. One of the two locations can contain an installed electrical contact with a contact band with a non-continuous loop or a gap. The contact element can be insert molded with a pin. The pin can have multiple pin grooves and can have contact bands with continuous loops and/or contact bands each with a gap connected to the pin grooves.

A connector assembly can have two electrical contacts installed at least partially surrounding the insulator of the pin and the two contact bands in offset axial positions with respect to the two contact bands and radially with respect to the locations of the two tabs. The two contact bands can each comprise a gap to enable snapping the contacts bands into the two spaced apart grooves.

A pin provided herein can comprise multiple pin grooves for accommodating multiple contact bands of multiple electrical contacts. The pin can comprise four pin grooves. In other examples, the pin can have a different number of pin grooves, such as one, two, three or more than four pin grooves for accommodating up to the same number of electrical contacts. By extending the length of the pin, such as the length of the tip section, multiple electrical contacts can be accommodated for use with multiple spring contacts having multiple independent electrical contact paths on a single pin body.

A pin provided herein can comprise two pin grooves with variations in groove designs and shapes. For example, the first pin groove can have a flat bottom surface while the second pin groove can have be V-shape with a subtended surface. In other examples, the first pin groove can have a V-shape with a subtended surface while the second pin groove can have a generally flat bottom surface, such as being generally U-shape. The different shaped grooves can accommodate electrical contacts with different contact band shapes. By varying the groove designs, the connectors described herein are not just limited to a singular design or single shape. The different shaped grooves can be selected to house the spring contacts differently.

A housing in accordance with aspects of the present disclosure can include a housing body with an exterior surface and an interior surface defining a bore. Two housing grooves can be incorporated in the bore of the housing, which can include a first housing groove and a second housing groove.

The two housing grooves can have variations in groove design. The two grooves can have different groove shapes, such as different groove wall surfaces with different angles and/or geometries. The first groove of the two grooves can have two sidewalls and a bottom wall located therebetween. The two sidewalls can be generally parallel to one another or one of the two sidewalls can form an obtuse angle with the bottom wall as shown. The second groove of the two grooves can have a V-shape. In other examples, the shapes of the first housing groove and the second housing groove can switch or can have other or different shapes.

A connector assembly can have a housing and a pin and wherein both the housing and the pin can each comprise a spring contact.

When assembling the pin with a spring contact to a housing with a spring contact, the connector assembly can have two spring contacts for two independent electrical contact paths. The housing can have a first housing groove and a second housing groove. One of the spring contacts can be located in the second housing groove. The pin can have a first pin groove and a second pin groove. The second spring contact can be located in the first pin groove of the pin. The two spring contacts can be oriented in a manner such that they do not interfere with one another during insertion of the pin into and/or removal of the pin from the bore of the housing.

In a connector assembly in which the housing and the pin both have a spring contact, the opening to the first open end of the housing and the first pin groove of the pin can be modified to accept the pin into the bore of the housing and to engage the spring contact located in the first pin groove with the modified first housing groove of the housing.

The second pin groove of the connector assembly comprising a contact with both a housing and a pin can be modified to pass through the first housing groove during insertion of the pin into the opening of the first open end of the housing to engage the spring contact located in the second housing groove. The first housing groove can have one sidewall and a bottom wall. The side opposite the one sidewall of the first housing groove can either be eliminated or substantially reduced in height compared to the one sidewall. Similarly, the second pin groove can have one sidewall and a bottom wall. The side opposite the one sidewall of the second pin groove can either be eliminated or substantially reduced in height compared to the one sidewall.

In an example, an electrical contact comprising a contact band is located in the pin groove of the pin in the contractor assembly in which both the pin and the housing comprises a spring contact. A tab can extend from the contact band and can extend along a length of the pin. In an example, the tab can be located along an exterior of the pin and optionally recessed to the pin via a channel formed with the pin. The spring contract can be in contact with the contact band of the electrical contact.

Methods of making and of using contact assemblies and components thereof as described herein are within the scope of the present invention.

BRIEF DESCRIPTION OF THE DRAWINGS

These and other features and advantages of the present devices, systems, and methods will become appreciated as the same becomes better understood with reference to the specification, claims and appended drawings wherein:

FIGS. 9A-B shows a first side view and a second side view rotated about the axis from the first side view of an electrical contact comprising a tab extending from a contact band.

FIGS. 10A-10B show a front end view and a perspective view of an electrical contact comprising a contact band and a tab extending from the contact band.

DETAILED DESCRIPTION

The detailed description set forth below in connection with the appended drawings is intended as a description of the presently preferred embodiments of connectors and contact assemblies provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1:
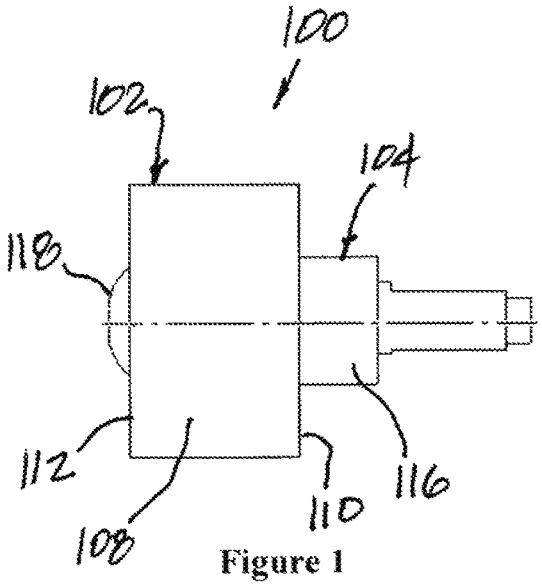
FIG. 1 shows an assembly drawing of a connector.

With reference now to FIG. 1, a side view of a connector assembly 100 comprising a housing 102 and a pin 104 is shown. The pin 104 being inserted into the bore of the housing 102 to connect the pin to the housing. The pin can latch to the housing by capturing a spring contact between two grooves. In an example, the housing 102 comprises a housing body 108 comprising two open ends having end openings, including a first open end 110 and a second open end 112. In other examples, the housing body 108 has a single open end 110 for receiving the pin 104 and a closed end. When there are two open ends 110, 112, part of the pin can project out the opening of the second open end 112. The housing 102 can be made from a metal material. The housing can be made from an electrically conductive metal material and can be coated or plated with one or more outer metal layers. Means can be provided to connect the pin and the housing. In some examples, as discussed below, the connector assembly can incorporate electrical contacts and functions as an electrical contact assembly. In exemplary embodiments, the housing can be made from a dielectric material or a non-conductive material and can incorporate electrical contacts for passing contact signals or current through the housing, similar to electrical contacts discussed further below for use with the pins of the present disclosure.

The pin 104 for use in or with the connector assembly 100 can comprise a pin body 116, one or more electrical contacts, and one or more spring contacts. The pin body 116 can be made from a non-conductive material or a dielectric material and can be an insulator or can be called an insulator material. High temperature resistant plastic, resin, polymer, or ceramic may be used to form the pin body. Non-limiting exemplary high temperature plastics and polymers can include Vespel®, Torlon®, PEEK (poletheretherketone), Ultem®, Radel®, Teflon®, Meldin®, Rulon®, Celazole®, and Macor®.

Figure 2:
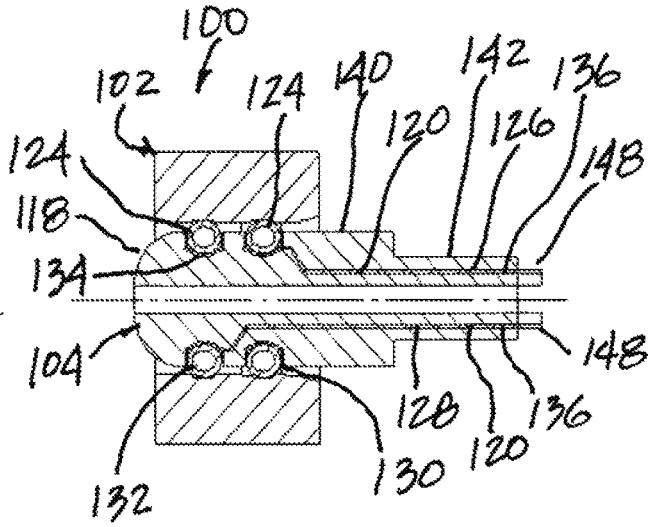
FIG. 2 shows a cross-sectional view of the connector of FIG. 1 with a direction of insertion of said pin into said housing along a centerline of the housing.

The cross-sectional view of the connector assembly 100 shown in FIG. 2 shows a housing 102 and a pin 104 with two electrical contacts 120 and two spring contacts 124. The two electrical contacts 120 can be identified as a first electrical contact 126 and a second electrical contact 128. The two spring contacts 124 can be identified as a first spring contact 130 and a second spring contact 132. In an example, the two spring contacts 124 can each be a canted coil spring. In particular examples, the canted coil spring can be a radial canted coil spring comprising a plurality of interconnected coils that all cant in generally the same direction and each comprising a major axis and a minor axis. In some examples, the coils of the canted coil spring can each have an elliptical shape and in a spring ring configuration. In some examples, the coils of the canted coil spring can each have a shape other than elliptical, such as square, triangle, or one of the complex coil shapes disclosed in U.S. Publication No. 2016/0076568 (the '568 publication), the contents of which are expressly incorporated herein by reference as if set forth in full.

The first electrical contact 126 has a contact band 134 (as further discussed below with reference to FIGS. 8-11) and a tab 136 located above the centerline of the pin 104 and the second electrical contact 128 has a contact band 134 and a tab 136 that is located below the centerline of the pin 104, in the orientation shown. The terms first and second are used to distinguish two components but not necessarily features or structures of the two components unless the context indicates otherwise. The pin 104 is shown with a hollow bore extending the length of the pin. In other examples, the hollow bore can extend only part of the length of the pin or the pin can have a solid core. The first and second electrical contacts 126, 128 can be substantially similar or can differ. For example, the two contact bands 134 can be substantially the same but the tabs have different lengths and/or different widths. Each tab can have a length that is at least as long as the width of the contact band. In other examples, the tab can have a length that is at least two times the width of the contact band. In some examples, the contact bands 134 can have different shapes for mounting onto different shaped grooves on the pin body 116 than as shown.

As shown in FIG. 2, the contact paths for electrical transmission between the housing 102 and the electrical contacts 120 mounted with the pin 104 are with or via the spring contacts 124, which can be canted coil springs each comprising a plurality of interconnected canted coils, all canted generally along the same direction. Alternatively, the spring contacts can be a ribbon spring or a V-spring. The pin 104 in FIG. 2 is shown with a tapered insertion end 118 to facilitate insertion of the pin into the bore of the housing. In some examples, the insertion end can embody a semi-spherical shape.

As shown in FIG. 2, the two electrical contacts 120 have contact bands 134 and tabs 136 that are assembled to the pin in an offset configuration with the two contact bands 134 of the two electrical contacts 120 concentric with the lengthwise axis of the pin and the contact band 134 of the second electrical contact 128 located closer to the tapered end section 118 of the pin 104 than the contact band 134 of the first electrical contact 126. Said differently, the pin 104 of FIG. 2 comprises contact bands positioned along the pin axis having different axial positions relative to the axial lengthwise axis of the pin.

In an example, the first and second electrical contacts 126, 128 do not touch one another. In another example, the first and second electrical contacts never touch one another. The electrical contacts are offset from each other, at least longitudinally or axially. In another example, the two electrical contacts, such as the first and second electrical contacts of FIG. 2, do not touch circularly or in the radial direction relative to the lengthwise axis of the pin. As shown, the bore of the housing 102 is sized so that the outer diameter of the pin does not touch the interior surface of the housing. Rather, the spring contacts 124 are sized so that electrical paths are provided by the spring contacts simultaneously contacting the housing and the two contact bands 134. In exemplary embodiments, the housing 102 is also provided with a non-conducting or a dielectric layer that separates the two areas where the two spring contacts 124 contact the interior surface of the housing defining the bore. This arrangement can provide two distinct electrical paths through the housing and the pin.

In an example, the pin 104 having the two electrical contacts 120 and the pin body 116 are formed by insert molding. The pin 104 can be formed with a tip section 140 and a tail section 142. The tip section can be formed with two slots or grooves having the two contact bands 134 located therein and the tail section 142 of the pin has the two tabs 136 of the two electrical contacts 120 embedded within the wall or boundary of the tail section 142. Thus, in an example, the pin body 116 of the pin 104 comprises two metallic bands 134 located in two spaced apart slots or grooves and two tabs embedded within the boundary or wall of the tail section 142. The ends of the two tabs 136, i.e., tab ends 148, can extend from the end most part of the tail section 142 of the pin. In an example, the two tab ends 148 can couple to wires, leads, cables, or other electrical sources for electrical communication with one or more electrical sources connected to the housing.

As previously described, the pin body 116 can be made from a non-conducting material or a dielectric material. At least some part or section of the pin body 116 can be placed between the electrical contacts 120 to isolate the first and second electrical contacts 126, 128 from one another. For example, parts or sections of the pin body can isolate or serve as a non-conducting element or dielectric layer between the two electrical contacts 120. This isolation between two adjacent electrical contacts enables the usage of multiple signals or conductive paths through a single connector assembly 100, such as through a single housing and a single pin. The centerline is provided to show the direction of insertion of said pin into said bore of said housing.

Electric power or data can be routed through the connector assembly 100 between two or more nodes. For example, a controller can connect to the housing 102 and two circuit boards can connect to the two tabs 136 extending along the tail section 142 of the pin. In other example, a power source can connect to the housing 102 and two different nodes, such as drivers, controllers, or motors connect to the two tabs 136 extending along the tail section 142 of the pin.

Figure 3:
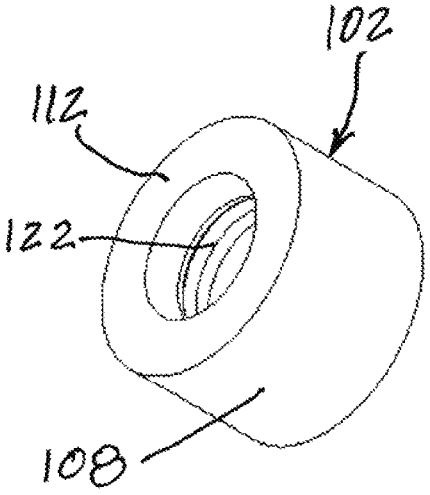
FIG. 3 shows an isometric view of the housing of the connector of FIG. 1.

FIG. 3 shows an isometric view of the housing 102 of the connector of FIGS. 1 and 2. The housing 102 is shown with an open end 112 having an opening 122. The housing 102 can have a similar opening 122 on the opposite open end 110. The housing 102 can be made entirely from a conductive material and can include dielectric or non-conductive layers or materials to isolate parts of the housing with an insulator. Optionally, the housing can be provided with a same number or conductive rings as there are spring contacts and the conductive rings can be insert molded with a housing body 108 made from a non-conductive or a dielectric material.

Figure 4:
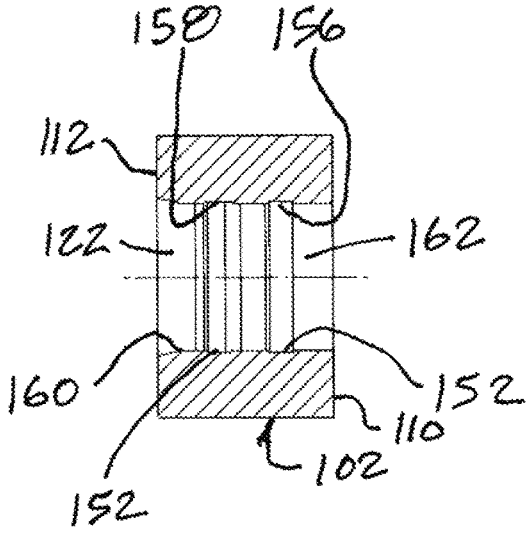
FIG. 4 shows a cross-sectional view of the housing of FIG. 3 with a centerline passing through the housing bore.

FIG. 4 shows a cross-sectional view of the housing 102 of FIG. 3, shown with annular grooves 152 formed by machining or recessing the nominal interior surface of the bore of the housing. The two grooves 152 can include a first groove or first housing groove 156 and a second groove or second housing groove 158. The housing 102 has an interior surface 160 defining the bore 162 of the housing. The two grooves 152 have groove bottom surfaces that are recessed from the interior surface 160 of the housing. Where the spring contacts 124 are pin mounted, as shown in FIG. 2, the spring contacts 124 may establish electrical contacts with the grooves 152 inside the bore 162 of the housing 102. The two housing grooves 156 may be in electrical communication with one another or may be electrically isolated from one another using one or more dielectric layer or non-conductive layers between them for separately contacting the two spring contacts 124 and two electrical contacts 120.

For the connector assemblies and connector assembly components disclosed hereinafter, it is understood that where a feature is shown but not expressly described and is otherwise the same or similar to the feature or features described elsewhere, such as above with reference to FIGS. 1-4, the disclosed part or parts shown in all the drawing figures but not expressly described because of redundancy and because knowledge is built on a foundation laid by earlier disclosures may nonetheless be understood to be described or taught by the same or similar features expressly set forth in the text for the embodiments in which the feature or features are described. Said differently, subsequent disclosures of the present application are built upon the foundation of earlier disclosures unless the context indicates otherwise. The disclosure is therefore understood to teach a person of ordinary skill in the art the disclosed embodiments and the features of the disclosed embodiments without having to repeat similar components and features in all embodiments since a skilled artisan would not disregard similar structural features having just read about them in several preceding paragraphs nor ignore knowledge gained from earlier descriptions set forth in the same specification. As such, the same or similar features shown in the following connector assemblies and connector components incorporate the teachings of earlier embodiments unless the context indicates otherwise. Therefore, it is contemplated that later disclosed embodiments enjoy the benefit of earlier expressly described embodiments, such as features and structures of earlier described embodiments, unless the context indicates otherwise.

Figure 5:
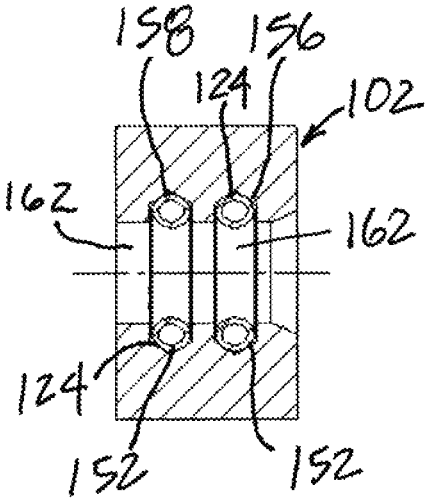
FIG. 5 shows a housing assembly comprising two spaced apart spring contacts sized and shaped to receive a pin along a direction of insertion of the centerline of the housing bore.

With reference now to FIG. 5, a housing-mounted spring contact is shown for use in a connector assembly with a pin, the pin being without spring contacts. Said differently, rather than mounting the spring contacts with a pin prior to engaging the pin to a housing, the present housing has housing grooves 152 that are sized and shaped to receive spring contacts 124, which can be canted coil springs, prior to receiving a pin within the bore of the housing. As shown, each housing groove 152 has a V-bottom and two sidewalls. In other examples, the housing groove 152 can have other groove shapes, such as a V-groove without sidewalls, a U-shape groove, a groove with two parallel sidewalls and a bottom wall that is flat, tapered or curved, etc. Each housing groove 152 has a depth that is sized to receive more than half of a coil minor axis of each coil of the plurality of coils of the spring contact and with part of each coil extending out of the housing groove 152 to be received by a corresponding mating groove on a pin. The centerline is shown to indicate the direction of insertion of a connecting pin into the housing to latch the pin to the housing, said pin comprising a pin body having a tip section and a tail section, at least one electrical contact having a contact band and a tab but no spring contact for use with a housing that has spring contacts mounted therewith.

Figure 6:
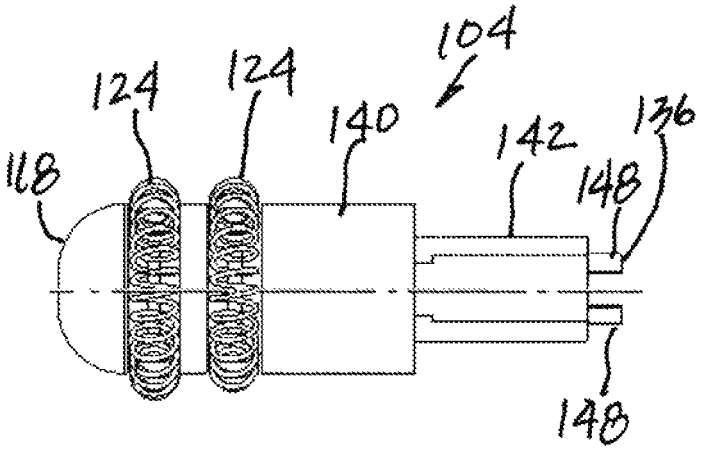
FIG. 6 shows a pin comprising an insulator separating two adjacent spring contacts and with two tabs that extend from two contact bands and each extending down the pin body.

FIG. 6 shows a pin 104 with two contact springs 124, such as two spaced apart canted coil springs prior to insertion of the pin into a housing. The pin 104 of FIG. 6, with spring contacts mounted thereon, is configured for insertion into a housing bore of a housing and wherein said housing is without spring contacts 124. The pin 104 of FIG. 6 can represent the pin 104 of FIG. 2 and can include two electrical contacts having contact bands and tabs assembled to the pin in an offset configuration. The two spring contacts 124 can contact the two contact bands on the two spring contacts. In other examples, the housing can have a spring contact and the pin can have a spring contact and wherein the pin with the spring contact can connect to the housing with the spring contact.

Figure 7:
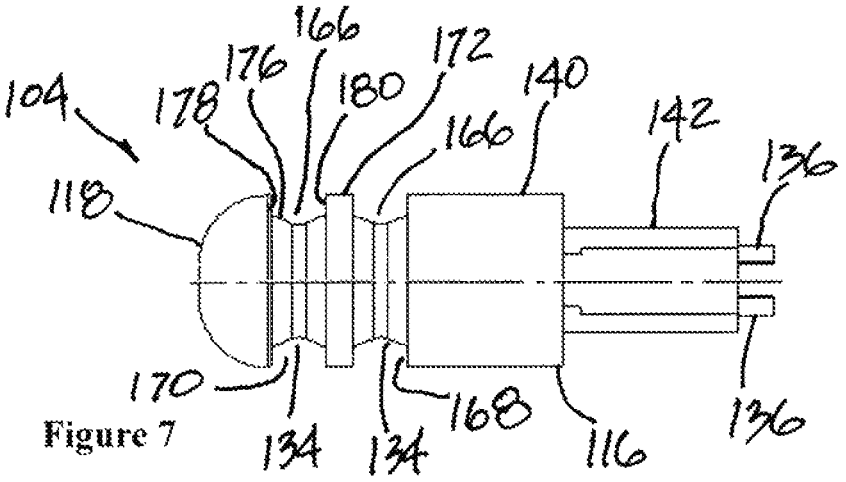
FIG. 7 shows a pin comprising an insulator and two electrical contacts each with a tab that extends from a contact band of the electrical contact and down the pin.

With reference now to FIG. 7, the pin 104 of FIGS. 1, 2, and 6 is shown without any spring contact. As shown, the pin 104 comprises a pin body 116 comprising a tip section 140 having two spaced apart pin grooves 166 and an insertion end 118 and a tail section 142. The tail section 142 can have an outer dimension, such as an outer diameter or outer circumference, that is smaller than an outer diameter or dimension of the pin body 116, away from the two pin grooves 166.

As discussed above, the pin body 116 may be formed from a dielectric or non-conducting material to function as an insulator separating two spring contacts and two electrical contacts from one another. The pin body 116 has two spaced part pin grooves 166, which may be referred to as a first pin groove 168 and a second pin groove 170. The two pin grooves are separated from one another by an insulating intermediate section 172, which can be an integral part of the tip section 140 of the pin 104. Each pin groove 166 can have a bottom wall 176 and two sidewalls 178, 180. The two sidewalls 178, 180 can be generally parallel to one another and the bottom wall 176 can be V-shape, V-shape with a subtended surface between two tapered surfaces of the V-shape, or V-shaped with a subtended surface without any sidewall. In an example, the two spaced apart pin grooves 166 have substantially the same shape. In other examples, the two grooves have different groove shapes, such as shown with reference to FIGS. 14A and 14B.

As previously discussed with reference to FIG. 2, two electrical contacts 120 are insert molded with the pin. Each electrical 120 contact can comprise a contact band 134 and a tab 136 extending from the band. As shown in FIG. 7, the two contact bands 134 are molded to the bottom walls 176 of the two grooves 166 and serve as bottom surfaces of the respective grooves for contacting corresponding spring contacts 124 (FIG. 6). Thus, as shown, each contact band 134 has a surface that resembles the bottom surface 176 of the respective pin groove 166. In some examples, the contact band 134 can have side lips that from parts of the two sidewalls of the respective pin groove.

Thus, aspects of the present connector assembly are understood to include a housing and a pin, said pin comprising an electrical contact comprising a contact band comprising an arcuate band section for enveloping at least part of the pin along a radial direction and a tab extending from the contact band and down the tail section of the pin. The arcuate band section can have a matching contour as a bottom of a pin groove. The tab can be integrated within the interior boundary of the tail section of the pin and have a tab end extending externally of the end of the tail section. In exemplary embodiments, a second electrical contact having a contact band spaced from the contact band of the first electrical contact is provided with the pin. The second contact band is situated in a second pin groove and has an arcuate band section having a matching contour as a bottom of the second pin groove.

Figure 8:
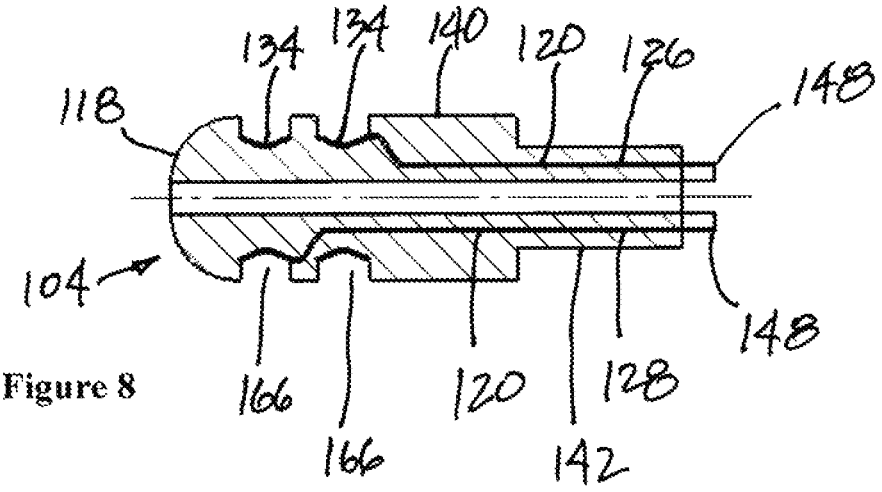
FIG. 8 shows a cross-sectional view of the pin of FIG. 7 comprising an insulator and two electrical contacts each with a tab that extends from a contact band and down the pin.

FIG. 8 is a cross-sectional side view of a pin 104 comprising two spaced apart pin grooves 166 and two electrical contacts 120. The present pin can be a cross-section of the pin of FIGS. 1, 6, and 7, but shown without spring contacts. The two electrical contacts 120 have contact bands 134 that are offset along an axial or longitudinal direction. The two contact bands 134 are generally V-shape and are located in corresponding grooves having two sidewalls and a center wall or bottom wall located therebetween, said bottom wall of the pin groove having a matching groove bottom surface as the cross-sectional contour of the contact band. The two pin grooves 166 with the contact bands 134 are sized and shaped to receive spring contacts. The two pin grooves 166 can have the same size and/or shape or can be different.

A tab 136 extends from each contact band 134. As shown, the tab 136 of the second electrical contact 128 has a length that is longer than the length of the tab 136 of the first electrical contact 126 since the contact band 134 of the second electrical contact 128 is located closer to the tapered end 118 than the contact band of the first electrical contact 126 but wherein the two tab ends 148 terminate on approximately the same plane. In other examples, the tab ends 148 can terminate along different axial positions.

The cross-sectional view of FIG. 8 verifies that the electrical contacts 126, 128 are not in contact with one another. The spaced relationship of the two electrical contacts 126, 128 allows the single pin 104 to have at least two or more spring contacts 124 (FIG. 6) for two or more electrical contact paths, which are spaced or isolated from one another. As shown, the two tabs 136 are routed inside the boundary or wall surface of the tail section of the pin and having two tab ends projecting out from the end most surface of the pin.

FIGS. 9A-B show two different side views, one rotated 90 degrees from the other, of an electrical contact 120 comprising a contact band 134 and a tab 136 in accordance with aspects of the present disclosure. The contact band 134 of the electrical contact 120 comprises an arcuate band section 190 that can have a matching contour as a bottom of a pin groove in which a spring contact can be located or positioned. The tab 136 is elongated and has a connecting portion 192 and an extension portion 194. The extension portion 194 has a length and a width with an arc section, which can form an arc around the lengthwise axis of the electrical contact. In an example, the width of the arc section of the tab can form about 10% to about 40% of a circumference of a circle. The length of the tab 136 allows the tab to extend down the pin or along at least part of the length of the pin. The connecting portion 192 is angled from contact band towards the lengthwise axis of the electrical contact 120. In an example, the contact band 134 and the tab 136 are unitarily formed and can include a weld to close the loop of the contact band. In other examples, the electrical contact can be formed by a stamping process and can involve welding to either close a seam of the contact band and/or to attach the tab to the contact band.

As shown, the arcuate band section 190 has two tapered walls 190*a*, 190*b* and a bottom wall 190*c* located therebetween. The arcuate band section 190 has a general V-shape with a subtended surface between the two inclined surfaces, which are also understood as being tapered walls. In an example, the electrical contact 120 can be made in whole or in part from stamped metal parts and cold worked to final fit. Optionally, the electrical contact 120 can be machined and welded when made from multiple separate pieces to final fit. The electrical contact can optionally be formed by metal injection molding or is molded by metal injection.

FIGS. 10A and 10B show a front end view and a perspective view of an electrical contact 120 comprising a contact band 134 and a tab 136 extending from the contact band. The electrical contact is configured for use with a pin described elsewhere herein and optionally with one or more other electrical contacts to enable the pin to have two or more electrical paths. As shown, the contact band 134 is a continuous loop. In other examples, the contact band 134 can be non-continuous, such as having a gap and can function as a snap ring. From the front view of FIG. 10A, the contact band can be seen having an inside diameter and an outside diameter. The connecting portion 192 on the tab 136 can be seen angling towards the center of the contact band.

From the perspective view of FIG. 10B, the contact band can be seen having a surface contour along the width of the contact band. As described with reference to FIGS. 9A and 9B, the contact band can have two tapered surfaces or tapered walls and a bottom wall or bottom surface. In other examples, the surface contour along the width can differ. For example, the surface can have a U-shape, can have an arc shape, and the two upper edges 190*d*, 190*d* of the two tapered walls can include an upwardly extending lip to form part of or the height of each of the two sidewalls of a pin groove. The tab 136 can have a connecting portion 192 and an extension portion 194 with a length and a width. The length of the tab can be selected as appropriate for use with a pin and the width of the tab can be about 10% to about 40% of a circumference of a circle and can have a general flat cross-sectional profile or an arc shape.

Figure 10C:
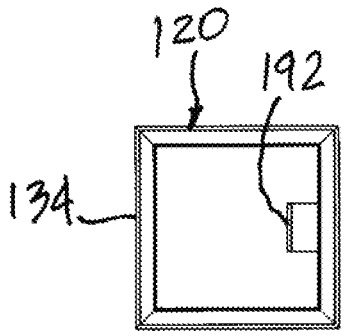
FIGS. 10C-10D show a front end view and a perspective view of an alternative electrical contact comprising a contact band and a tab extending from the contact band.
Figure 10D:
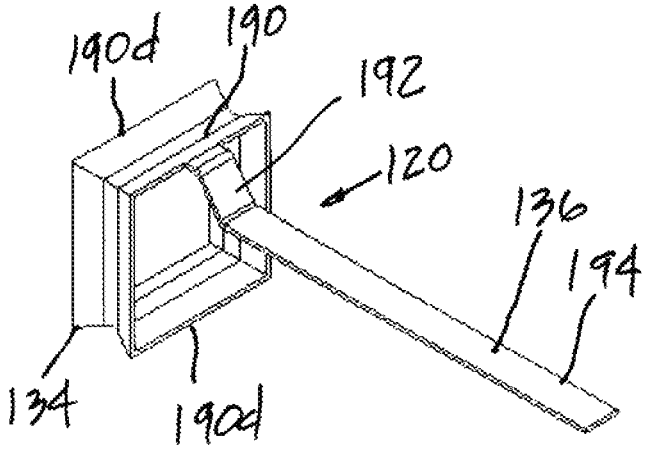

FIGS. 10C and 10D show a front end view and a perspective view of an alternative electrical contact 120 comprising a contact band 134 and a tab 136 extending from the contact band. The electrical contact is configured for use with a pin described elsewhere herein and optionally with one or more other electrical contacts to enable the pin to have two or more electrical paths. As shown, the contact band 134 is a continuous loop and has a generally square shape. In other examples, the contact band 134 can be non-continuous and can have a different shape, such as a generally rectangular shape.

From the front view of FIG. 10C, the contact band can be seen having an inside diameter and an outside diameter. The connecting portion 192 on the tab 136 can be seen angling towards the center of the contact band. From the perspective view of FIG. 10D, the contact band can be seen having a surface contour along the width of the contact band. As described with reference to FIGS. 9A and 9B, the contact band can have two tapered surfaces or tapered walls and a bottom wall or bottom surface. In other examples, the surface contour along the width can differ. For example, the surface can have a U-shape, can have an arc shape, and the two upper edges 190*d*, 190*d* of the two tapered walls can include an upwardly extending lip to form part of or the height of the two sidewalls of a pin groove. The tab 136 can have a connecting portion 192 and an extension portion 194 with a length and a width. The length of the tab can be selected as appropriate for use with a pin and the width of the tab can be about 10% to about 40% of the width of one of sides of the contact band and can have a general flat cross-sectional profile or an arc shape.

Figure 10E:
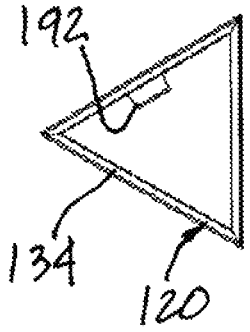
FIGS. 10E-10F show a front end view and a perspective view of an alternative electrical contact comprising a contact band and a tab extending from the contact band.
Figure 10F:
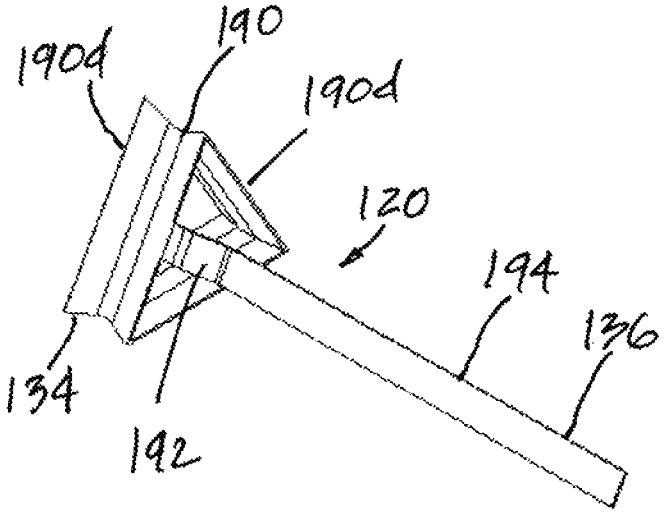

FIGS. 10E and 10F show a front end view and a perspective view of an alternative electrical contact 120 comprising a contact band 134 and a tab 136 extending from the contact band. The electrical contact is configured for use with a pin described elsewhere herein and optionally with one or more other electrical contacts to enable the pin to have two or more electrical paths. As shown, the contact band 134 is a continuous loop and has a generally triangular shape. In other examples, the contact band 134 can be non-continuous and can have a different shape, such as generally rectangular or oval.

From the front view of FIG. 10E, the contact band can be seen having an inside dimension and an outside dimension. The connecting portion 192 on the tab 136 can be seen angling towards the center of the contact band. From the perspective view of FIG. 10F, the contact band can be seen having a surface contour along the width of the contact band. As described with reference to FIGS. 9A and 9B, the contact band can have two tapered surfaces or tapered walls and a bottom wall or bottom surface. In other examples, the surface contour along the width can differ. For example, the surface can have a U-shape, can have an arc shape, and the two upper edges 190*d*, 190*d* of the two tapered walls can include an upwardly extending lip to form part of or the height of the two sidewalls of a pin groove. The tab 136 can have a connecting portion 192 and an extension portion 194 with a length and a width. The length of the tab can be selected as appropriate for use with a pin and the width of the tab can be about 10% to about 40% of a the width of one of sides of the contact band and can have a general flat cross-sectional profile or an arc shape.

Figure 10G:
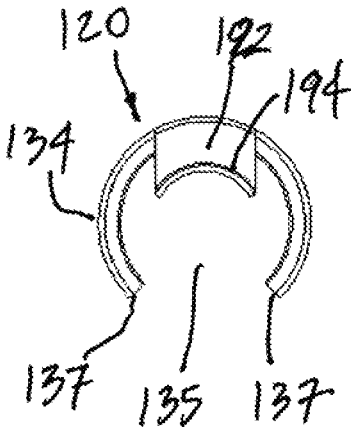
FIGS. 10G-10H show a front end view and a perspective view of an alternative electrical contact comprising a contact band and a tab extending from the contact band.
Figure 10H:
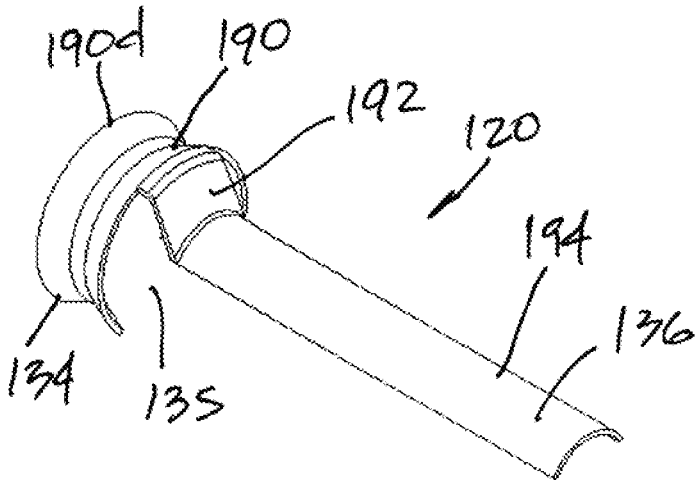

FIGS. 10G and 10H show a front end view and a perspective view of an alternative electrical contact 120 comprising a contact band 134 and a tab 136 extending from the contact band. The electrical contact is configured for use with a pin elsewhere herein and optionally with one or more other electrical contacts to enable the pin to have two or more electrical paths. As shown, the contact band 134 is a non-continuous loop with a gap 135 between two band side edges 137. The band has generally round shape with a gap. The contact band 134 is not closed off so that it may at least partially surround the insulator, such as a pin, around a majority of the circumference thereof.

From the front view of FIG. 10G, the contact band can be seen having an inside dimension and an outside dimension. The connecting portion 192 on the tab 136 can be seen angling towards the center of the contact band. From the perspective view of FIG. 10H, the contact band can be seen having a surface contour along the width of the contact band. As described with reference to FIGS. 9A and 9B, the contact band can have two tapered surfaces or tapered walls and a bottom wall or bottom surface. In other examples, the surface contour along the width can differ. For example, the surface can have a U-shape, can have an arc shape, and the two upper edges 190*d*, 190*d* of the two tapered walls can include an upwardly extending lip to form part of or the height of the two sidewalls of the pin groove. The tab 136 can have a connecting portion 192 and an extension portion 194 with a length and a width. The length of the tab can be selected as appropriate for use with a pin and the width of the tab can be about 10% to about 40% of a circumference.

The non-continuous configuration of the contact band 134 of the present electrical contact embodiment enables the contact band to snap onto a pin made from a non-conducting or a dielectric material rather than assembling to the pin by insert molding, although the latter process is still an option. The connecting portion 192 and the extension portion 194 can be adjusted when using the electrical contact 120 of FIGS. 10G and 10H by snap fit to a pre-formed pin made from a non-conducting or a dielectric material.

Figure 10I:
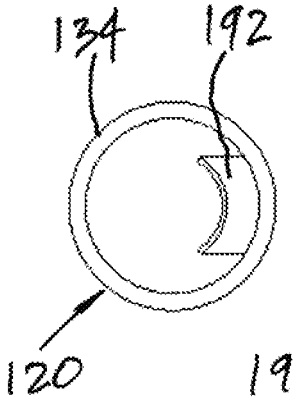
FIGS. 10I-10J show a front end view and a perspective view of an alternative electrical contact comprising a contact band and a tab extending from the contact band.
Figure 10J:
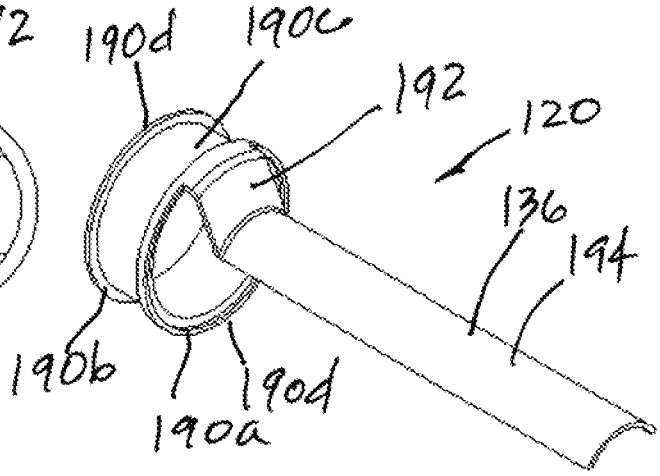

FIGS. 10I and 10J show a front end view and a perspective view of an electrical contact 120 comprising a contact band 134 and a tab 136 extending from the contact band. The electrical contact 120 is configured for use with a pin described elsewhere herein and optionally with one or more other electrical contacts to enable the pin to have two or more electrical paths. As shown, the contact band 134 is a continuous loop. In other examples, the contact band 134 can be non-continuous, such as having a gap and can function like a snap ring.

From the front view of FIG. 10I, the contact band can be seen having an inside diameter and an outside diameter. The connecting portion 192 on the tab 136 can be seen angling towards the center of the contact band. From the perspective view of FIG. 10J, the contact band can be seen having a surface contour along the width of the contact band. In the present embodiment, the width has a generally U-shape with two short sidewalls 190*a*, 190*b* and a bottom wall 190*c* located therebetween. The bottom wall 190*c* is generally flat and the surface contour of the bottom wall is generally parallel to the lengthwise axis of the electrical contact. In other examples, the surface contour along the width can differ. For example, the surface can have a V-shape, can have an arc shape, and the two upper edges 190*d*, 190*d* of the two tapered walls can include an upwardly extending lip to form part of or the height of each of the two sidewalls of the pin groove. In still other examples, the two sidewalls 190*a*, 190*b* can be omitted and the tab 136 extending directly from the bottom wall. The tab 136 can have a connecting portion 192 and an extension portion 194 with a length and a width. The length of the tab can be selected as appropriate for use with a pin and the width of the tab can be about 10% to about 40% of a circumference of a full circle and can have a general flat cross-sectional profile or an arc shape.

Figure 11:
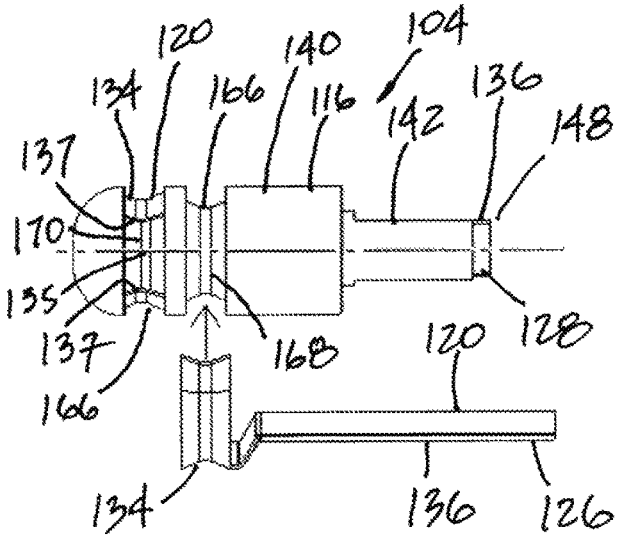
FIG. 11 shows an electrical contact with a tab configured to partially surround the pin and along a lengthwise axis of the pin with an arrow indicating the direction of a snap on process in which the pin can hold the electrical contact to be snapped on and the electrical contact in the other of the two slots or grooves.

FIG. 11 shows a side view of a pin 104 comprising a pin body 116 having a tip section 140 and a tail section 142, similar to other pins described elsewhere herein and is configured for use with a housing in a connector assembly. The pin 104 further comprises two pin grooves 166 including a first pin groove 168 and a second pin groove 170. In other examples, additional pin grooves can be incorporated. A contact band 134 of an electrical contact 120 having a gap 135 or a non-continuous loop is shown attached to the second groove 170 with two side edges 137, 137 and the gap 135 clearly shown. The electrical contact 120, being located in the second pin groove, may be referred to as a second electrical contact 128. A tab 142 extends from the contact band 134 that is attached to the second groove 170 and extends along the tail section 142 and having a tab end 148 extending beyond the end of the tail section. The tip section 140 of the pin is provided with lengthwise channels to accommodate the width of the tab running from the area of the grooves through the remainder of the tip section 140 and along the tail section 142 of the pin. Adhesive, heat welds, detents, or combinations thereof may be used to secure the tab to the pin.

Another electrical contact 120 is shown spaced from the pin 104 and shown in the process of snapping onto the pin 104. The pin can comprise a non-conducting material or materials for use as an isolator to isolate the electrical contacts and spring contacts. The arrow shows the direction of assembling of the electrical contact onto the first pin groove 168 of the pin. This spaced electrical contact 120 that is in the process of being mounted to the pin may be referred to as a first electrical contact 126 and has a contact band 134 with a gap located between two side edges, similar to the contact band of the second electrical contact 128. The tab 136 extending from the contact band can pass through a lengthwise channel formed through or in the tip section 140 of the pin with the remaining portion of the tab extending along the exterior of the tail section 142. The tail section 142 may also include a lengthwise channel so that the tab can recess from the exterior surface of the tail section.

Thus, FIG. 11 shows a process in which an electrical contact 120 has a contact band 134 and wherein the contact band at least partially surrounds the insulator around the axis of the pin. FIG. 11 shows two locations where two electrical contacts can be located. One of the two locations can contain an installed electrical contact 120 that has a contact band with a non-continuous loop or an insert molded electrical contact similar to FIG. 8. The other location or pin groove is indicated with an arrow showing the direction which the electrical contact 120 can snap onto the pin 104 and for the contact band with a gap to snap into the first groove 168.

Figure 12:
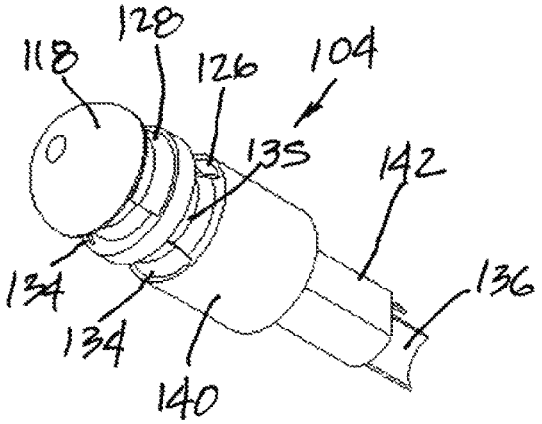
FIG. 12 shows a pin in which two electrical contacts, one with each of the two slots or grooves of the pin, are snapped on and offset with each other.

FIG. 12 shows an isometric view of the pin 104 of FIG. 11 after assembly. As shown, the two electrical contacts 120 are installed at least partially surrounding the insulator, and are shown in offset positions axially with respect to the two contact bands and radially with respect to the locations of the two tabs. The two contact bands each comprises a gap to enable snapping the contacts bands into the two spaced apart grooves.

Figure 13A:
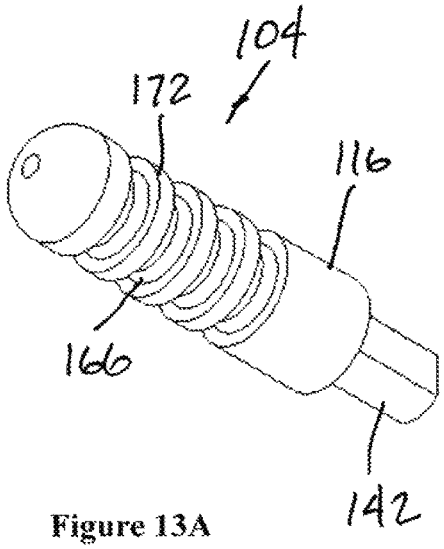
FIGS. 13A and 13B, in perspective and side depictions, show a pin comprising more than two slots or grooves to receive more than two electrical contacts.
Figure 13B:
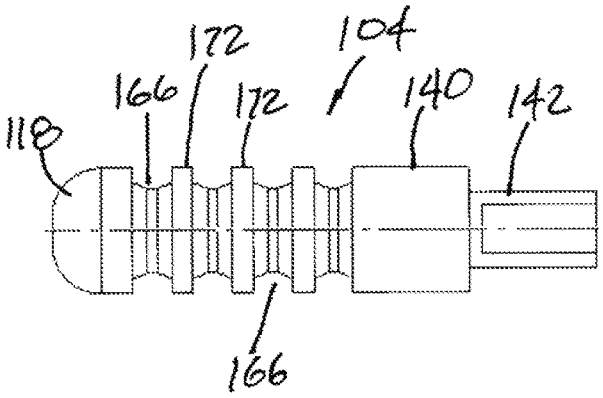

FIGS. 13A and 13B show an isometric view and side view of an alternative pin 104 in accordance with aspects of the present disclosure. As shown, the pin 104 comprises multiple pin grooves 166 for accommodating multiple contact bands of multiple electrical contacts. In the present embodiment, the pin 104 comprises four pin grooves 166. In other examples, the pin can have a different number of pin grooves, such as one, two, three or more than four pin grooves for accommodating the same number of electrical contacts. By extending the length of the pin 104, such as the length of the tip section 140, multiple electrical contacts can be accommodated for use with multiple spring contacts having multiple independent electrical contact paths on a single pin body.

Figure 14A:
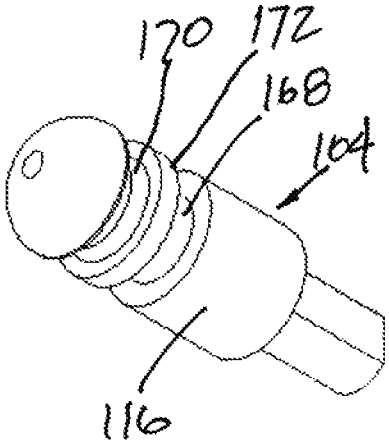
FIGS. 14A and 14B, in perspective and side depictions, show a pin for receiving two contact bands of two electrical contacts having two different shaped contact bands to be received in different grooves or slots of different shapes.
Figure 14B:
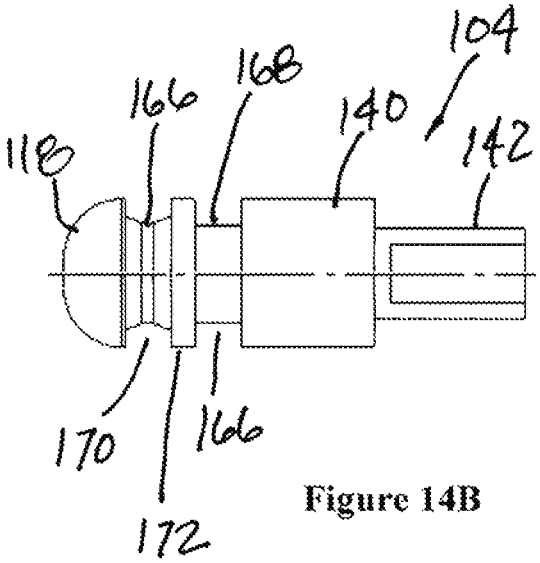

FIGS. 14A and 14B show yet another alternative pin 104 in accordance with aspects of the present disclosure, in an isometric view and a side view. As shown, the pin 104 comprises two pin grooves 166 with variations in groove designs and shapes. For example, the first pin groove 168 can have a flat bottom surface while the second pin groove 170 can have be V-shape with a subtended surface. In other examples, the first pin groove can have a V-shape with a subtended surface while the second pin groove can have a generally flat bottom surface, such as being generally U-shape. The different shaped grooves can accommodate electrical contacts with different contact band shapes. By varying the groove designs, the connectors described herein are not just limited to a singular design or single shape. The different shaped grooves can be selected to house the spring contacts differently.

Figure 15:
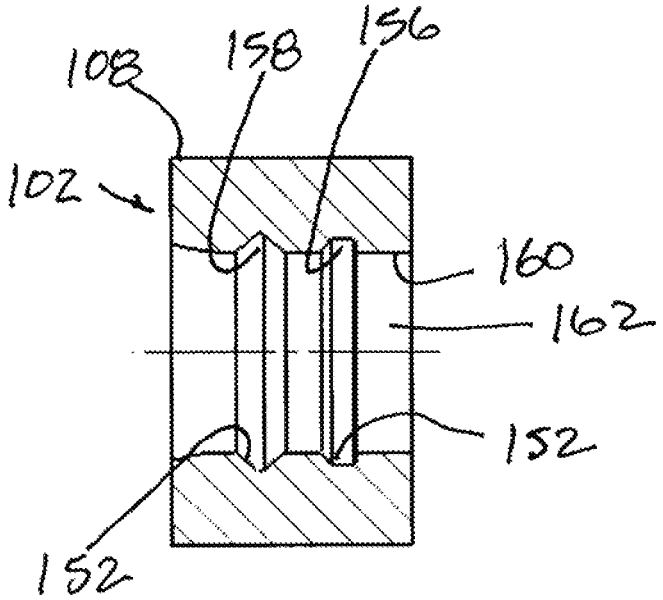
FIG. 15 shows a housing wherein the contact locations within the bore of the housing comprise variations in groove designs or groove shapes.

FIG. 15 shows an alternative housing 102 provided in accordance with aspects of the present disclosure, which can be used in a connector assembly described elsewhere herein for use with a pin as described elsewhere herein. The housing 102 has a housing body 108 with an exterior surface and an interior surface 160 defining a bore 162. Two housing grooves 152 are incorporated in the bore 162 of the housing, which include a first housing groove 156 and a second housing groove 158. The two housing grooves are shown with variations in groove design. As shown, the two grooves have different groove shapes, such as different groove wall surfaces with different angles and/or geometries. The first groove 156 can have two sidewalls and a bottom wall located therebetween. The two sidewalls can be generally parallel to one another or one of the two sidewalls can form an obtuse angle with the bottom wall as shown. The second groove 158 can be V-shape. In other examples, the shapes of the first housing groove and the second housing groove can switch or can have other or different shapes.

Figure 16:
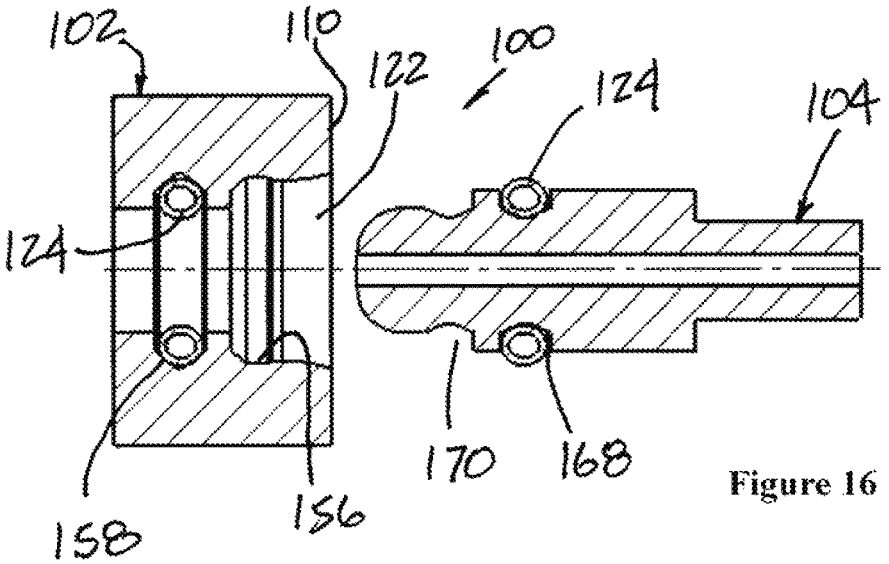
FIG. 16 shows a connector assembly wherein both a housing and a pin each comprises a spring contact with a direction of insertion along the centerline forming a connector with multiple contacts when assembled or connected.
Figure 17A:
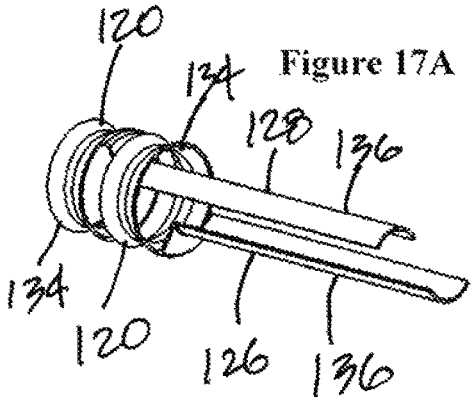
FIGS. 17A-17D show different views of two electrical contacts with contact bands and tabs arranged in line for use with a pin having two slots or grooves.
Figure 17B:
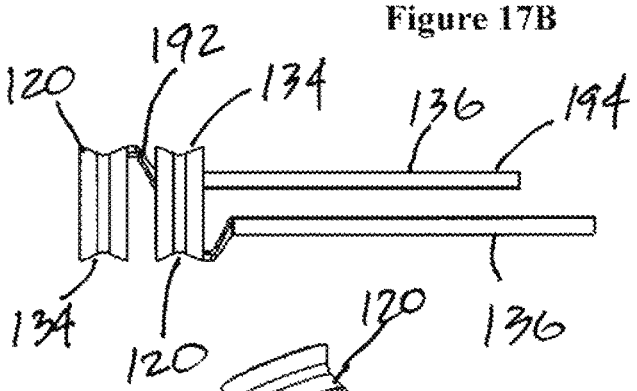
Figure 17C:
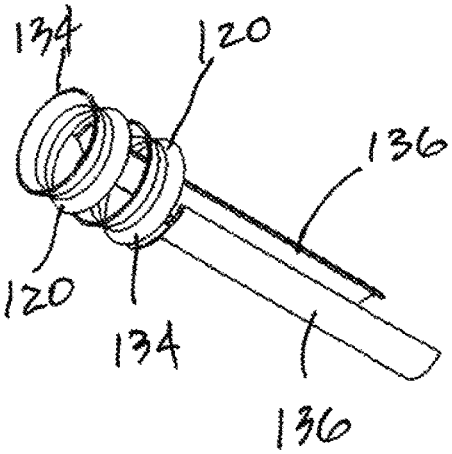
Figure 17D:
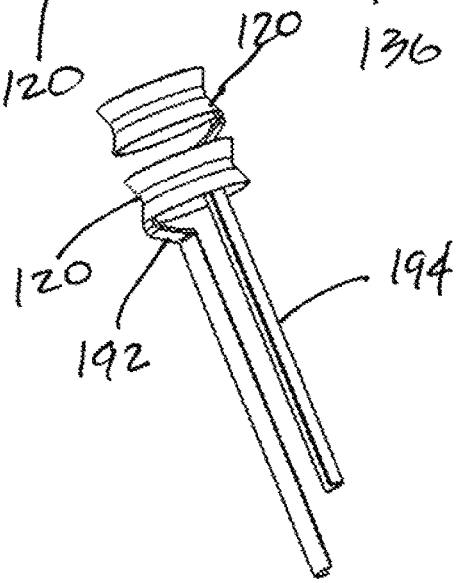

FIG. 16 shows a connector assembly 100 comprising a housing 102 and a pin 104. In the present embodiment, both the housing and the pin each comprises a spring contact 124. When assembling the pin 104 to the housing 102, the connector assembly 100 of the present embodiment has two spring contacts 124 for two independent electrical contact paths. A centerline is shown to show the direction of insertion of the pin along the centerline. As shown, the housing has a first housing groove 156 and a second housing groove 158. One of the spring contacts 124 is located in the second housing groove 158. The pin has a first pin groove 168 and a second pin groove 170. The second spring contact 124 is located in the first pin groove 168 of the pin. The two spring contacts 124 are oriented in a manner such that they do not interfere with one another during insertion of the pin into and removal of the pin from the bore of the housing.

For the connector assembly embodiment of FIG. 16, the opening 122 to the first open end 110 of the housing 102 and the first pin groove 156 are modified to accept the pin into the bore of the housing and to engage the spring contact 124 located in the first pin groove 168 with the modified first housing groove of the housing. Similarly, the second pin groove 170 has been modified to pass through the first housing groove 156 during insertion of the pin into the opening of the first open end 110 to engage the spring contact 124 located in the second housing groove 158. As shown, the first housing groove 156 has one sidewall and a bottom wall. The side opposite the one sidewall of the first housing groove 156 is either eliminated or substantially reduced in height compared to the one sidewall. Similarly, the second pin groove 170 has one sidewall and a bottom wall. The side opposite the one sidewall of the second pin groove 170 is either eliminated or substantially reduced in height compared to the one sidewall.

In an example, an electrical contact comprising a contact band is located in the pin groove 168 of the pin of FIG. 16 and a tab extending from the contact band extends along the length of the pin. In an example, the tab can be located along an exterior of the pin and optionally recessed to the pin via a channel formed with the pin. The spring contract 124 can be in contact with the contact band of the electrical contact.

FIGS. 17A-17D show different views of a pair electrical contacts 120, including a first electrical contact 126 and a second electrical contact 128, each with a contact band 134 and a tab 136. The two electrical contacts 120 are shown in an axially offset configuration, similar to that shown in FIGS. 2 and 8. The two electrical contacts 120 can be positioned in the axially offset position as shown inside a mold for insert molding with a pin to form the pin shown in FIGS. 2 and 8. The inclined connecting portion 192 of the second electrical contact 128 is angled in such a way that it is spaced from the contact band of the first electrical contact 126 so as to avoid shorting. Although the two contact bands 134 of the two electrical contacts 120 are shown being the same, the two contact bands can have different band shapes.

Methods of making and of using contact assemblies and components thereof as described herein are within the scope of the present invention.

Although limited embodiments of the connector assemblies and their components have been specifically described and illustrated herein, many modifications and variations will be apparent to those skilled in the art. Accordingly, it is to be understood that the connector assemblies and their components constructed according to principles of the disclosed devices, systems, and methods may be embodied other than as specifically described herein. The disclosure is also defined in the following claims.

What is claimed is:

1. An electrical connector assembly comprising:

a pin comprising an insulator material, a groove, and an electrical contact;

a housing comprising an exterior surface and an interior surface defining a bore;

a canted coil spring contact;

a direction of insertion of said pin into said bore of said housing;

wherein the pin comprises an axis in the direction of insertion;

wherein the canted coil spring contact is retained with the groove of the pin prior to insertion of the pin into the bore of the housing;

wherein the electrical contact comprises a contact band having an outside diameter, said contact band at least partially surrounds the insulator material around the axis of the pin;

wherein said electrical contact comprises a tab extending from the contact band and along at least a length of the pin, the tab having a connecting portion and an extension portion;

wherein the canted coil spring contact establishes an electrical path between the pin and the housing; and wherein the connecting portion of the tab is located inwardly of a projection defined by the outside diameter of the contact band.

2. The electrical connector assembly according to claim 1, wherein the electrical contact is a first electrical contact and the canted coil spring contact is a first spring contact; and further comprising a second electrical contact and a second canted coil spring contact said second electrical contact comprising a contact band having an outside diameter and a tab located inwardly of a projection defined by the outside diameter of the contact band.

3. The electrical connector assembly according to claim 2, wherein the groove of the pin comprises two spaced apart pin grooves including a first pin groove and a second pin groove and wherein the first electrical contact is located in the first pin groove and the second electrical contact is located in the second pin groove.

4. The electrical connector assembly according to claim 1, wherein the contact band has two slanted surfaces relative to the axis.

5. The electrical connector assembly according to claim 1, wherein the tab of the electrical contact is connected to a source.

6. The electrical connector assembly according to claim 1, wherein the tab of the electrical contact is connected to a receiver.

7. The electrical connector assembly according to claim 1, wherein the contact band of the electrical contact and a contact band of a second electrical contact are offset longitudinally along the pin.

8. The electrical connector assembly according to claim 1, wherein the electrical contact is stamped from a metal sheet.

9. The electrical connector assembly according to claim 1, wherein the contact band defines a plane and wherein the tab has an extension portion extending orthogonally to the plane.

10. The electrical connector assembly according to claim 1, wherein the pin and the contact element are formed by insert molding.

11. The electrical connector assembly according to claim 1, wherein the electrical contact is formed by metal injection molding or is molded by metal injection.

12. The electrical connector assembly according to claim 1, wherein the electrical contact comprises copper or a copper alloy.

13. A method of using the electrical connector assembly of claim 1, comprising the step of separating the pin from the bore of the housing.

14. A method of making the electrical connector assembly of claim 1, comprising the step of assembling the contact assembly to the pin.

15. An electrical connector assembly comprising:

a housing comprising an exterior surface and an interior surface defining a bore;

a pin located in the bore of the housing, the pin comprising a groove, a tip section, and a tail section, said tip section having a first diameter and said tail section having a second diameter, which is smaller than the first diameter;

a canted coil spring contact contacting a contact band of an electrical contact, said electrical contact comprising a tab extending from the contact band and said canted coil spring contact and said contact band located inside the bore of the housing; and wherein said tab extends along a length of said tail section of said pin, at least partially along the second diameter of the tail section; and wherein the canted coil spring contact is retained with the groove of the pin prior to insertion of the pin into the bore of the housing.

16. The electrical connector assembly of claim 15, wherein the contact band is located in the groove of the pin.

17. The electrical connector assembly of claim 16, wherein said tab is embedded inside said tail section.

18. The electrical connector assembly of claim 16, wherein said contact band has a gap and two side edges defining the gap.

19. The electrical connector assembly of claim 15, further comprising a second canted coil spring contact and a second contact element comprising a contact band and a tab, said tab of said second contact element extending along the length of said tail section of said pin and through said contact band of said first contact element.

20. The electrical connector assembly of claim 15, wherein the canted coil spring contact is located in a pin groove of the pin and a second canted coil spring contact is located in a housing groove of the housing.

* * * * *